United States Patent [19]

Tani et al.

[11] Patent Number: 4,976,826

[45] Date of Patent: Dec. 11, 1990

[54] METHOD OF MAKING ELECTRODEPOSITED COPPER FOIL

[75] Inventors: Toshio Tani; Osamu Kamiyama; Noborn Matsuki; Ryosaku Fukuda; Tsukasa Akutsu; Hiroshi Nakatsugawa, all of Imaichi, Japan

[73] Assignee: Furukawa Circuit Foil Co., Ltd., Tokyo, Japan

[21] Appl. No.: 481,434

[22] Filed: Feb. 16, 1990

[51] Int. Cl.[5] ..... C25D 1/04; C25D 7/06

[52] U.S. Cl. ..... 204/12; 204/27

[58] Field of Search ..... 204/12, 27, 52.1

[56] References Cited

U.S. PATENT DOCUMENTS 4,820,388 4/1989 Kurze ..... 204/52.1

*Primary Examiner*—T. M. Tufariello

*Attorney, Agent, or Firm*—Frishauf, Holtz, Goodman & Woodward

[57] ABSTRACT

Disclosed is a method of making electrodeposited copper foil which comprises carrying electrolysis by adding a water-soluble cellulose ether to an electrolytic solution.

A profile of the matte side nodules of the electrodeposited copper foil obtained by the method of the present invention can be easily controlled, and the electrodeposited copper foil which is high above IPC specification Class 3 in elongation at room temperature and high temperature can be obtained.

11 Claims, 1 Drawing Sheet

METHOD OF MAKING ELECTRODEPOSITED COPPER FOIL

BACKGROUND OF THE INVENTION

This invention relates to method of making electrodeposited copper foil, more particularly to method of making electrodeposited copper foil suitable for a printed circuit An electrodeposited copper foil for a printed circuit has been commercially manufactured by contacting electrolytic solution of copper sulfate aqueous solution with an insoluble anode such as lead and cathode rotary drum made of stainless steel or titanium, to get copper electrodeposited copper on the cathode drum and winding it continuously.

Generally, when an aqueous solution contains only a copper ion and sulfuric acid ion as an electrolytic solution, pin hole or microporosity is generated on the copper foil due to dust or oil involuntarily existing in the system and causes serious problems for practical use. Also, the shape of promortories of a matte side which contacts with the electrolytic solution deforms so that sufficient adhesion strength cannot be obtained when adhering the foil to an insulating material at later stage. Further, it causes the problem that roughness becomes so large that insulation resistance between conductor layers or circuit conductivity becomes low, or transfer of copper to the unwanted portion of copper and undercut of the conductor after etching are increased whereby various properties as the printed are damaged.

In order to prevent the pinhole, a chlorine ion is added in the electrolytic solution, or the electrolytic solution is filtered by passing it through a filter containing an activated carbon to remove dust and oils. Also, for preventing microporosity and improving the shape of the matte side promontories, glue has heretofore been added to the electrolytic solution and it has been proposed to add various organic, inorganic materials as additives other than glue.

However, a material which is industrially more excellent than glue has never been discovered in the point of quality stabilities of a copper foil obtained therefrom.

In recent years, developments in electronic circuit technology including a semiconductor and integrated circuit are remarkable, and in the printed circuit board, boards such as single-sided and double-sided boards to multilayer boards having tens of layers have been practiced for general-purpose because of improvement in each technology such as insulation, laminating, drilling, interlayer connection, etching, component mounting, heat dissipation and printed board inspection systems. As the technology movement, since high density wiring has increasingly demanded, tendencies of highly multilayered, fine pattern and large-sized board are becoming remarkable.

For high multilayer, an insulating layer and a conductor should be made thin. For fine patterning, it is required to make a conductor thin, prevent foil crack and decrease undercut at etching. Also, for large-sizing of the multilayer board, dimensional stability is necessary. Thus, for the copper foil itself as the conductive foil, it has been required characteristics such as improved insulating and dielectric characteristics, decreased conductor resistance and low profile (decrease in roughness) of the matte side to reduce undercut as well as improved high temperature elongation to prevent foil crack due to thermal stress.

Low profiling of the matte side can be accomplished, for example, by adding a large amount of glue as mentioned above to the electrolytic solution, but accompanying increase of the amount added, rooml temperature and high temperature elongation are abruptly lowered. On the other hand, a copper foil obtained from an electrolytic solution containing no glue which is passed through an activated carbon filter has extremely high elongation at room temperature and high temperature, but shape of the promontories deforms and roughness becomes large. Further, when electrodeposited current density is suppressed to low, the resulting foil has low profile and is improved in elongation as compared with a foil prepared with high current density. However, it is hard to make uniform the low profile with a desired degree and productivity becomes low whereby it is not preferred from an economical view. As stated above, an electrodeposited copper foil having both of the low profiled matte side and a high elongation at high temperature satisfying the requirement in high density wiring can hardly be produced industrially by the prior art.

SUMMARY OF THE INVENTION

The present invention is to provide a method of making electrodeposited copper foil having high elongation at high temperature and low profiled matte side, which rewards to the demand from high density wiring of a printed circuit board with easily and economically.

That is, the method of making electrodeposited copper foil which is suitable for a printed circuit of the present invention comprises carrying electrolysis by adding a water-soluble cellulose ether in an electrolytic solution.

DESCRIPTION OF THE PREFERRED EMBODIMENTS

Figure 1:
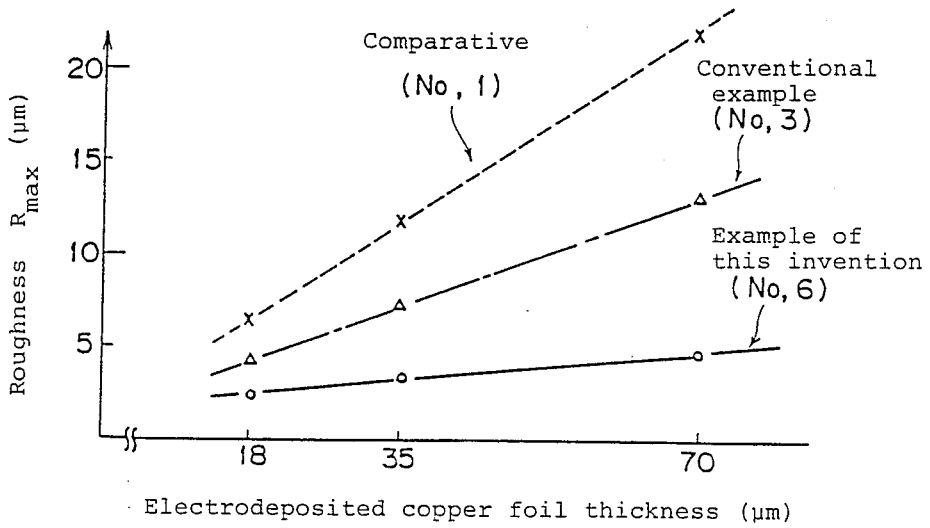
FIG. 1 is a graph showing a test result of Example 2.

Cellulose ether of the present invention is a compound in which a part or all of three hydroxyl groups of a unit cellulose represented by the following formula:

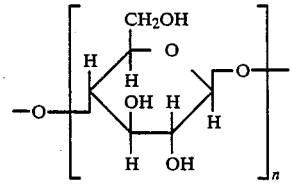

is/are etherified with a substituent(s). Since the electrolytic solution is an aqueous solution, the cellulose ether to be used is also water-soluble one. Preferred eater-soluble cellulose ether may preferably include those in which a substituent for etherification has, for example, a hydroxyl group at the terminal or those having an ionic substituent in which a terminal hydrogen of a carboxyl group is replaced by a monovalent cation, and further preferably a water-soluble cellulose ether combinedly having ether linkages according to plural number of different substituents. As exemplary compounds which are industrially and cheaply produced, there may be mentioned, for example, sodium carboxymethyl cellulose, potassium carboxymethyl cellulose, ammonium carboxymethyl cellulose, hydroxyethyl cellulose, sodium carboxymethylhydroxyethyl cellulose, potassium carboxymethylhydroxyethyl cellulose and ammonium carboxymethylhydroxyethyl cellulose. Other than the above, water-soluble ones of methyl cellulose and cyanoethyl cellulose may be also used.

Solubility of the cellulose ether is varied depending on a degree of etherification of cellulose ether, i.e. degree of substitution (D.S., an average number of hydroxyl groups of cellulose which are substituted and etherified by substituents, the maximum value for D.S. is 3), or molar substitution (M.S., an average molar number of substituents added to each cellulose unit, theoretical maximum value for M.S. is infinity), but it may be any one so long as water-soluble. Those which are industrially produced are having a D.S. value of about 0.5 to 1.5 and a M.S. value of about 1 to 2 or so.

The reason why the cellulose ether is limited only to water-soluble one is that the electrolytic solution is an aqueous solution so that it is required to mix uniformly in the electrolytic solution. Powder state ones may be thrown into a tank and dissolved at dissolving a copper starting material. However, when a filter such as activated carbon is used, at least a part of the cellulose ether dissolved is adsorbed and removed so that the cellulose ether is preferably dissolved in water or hot water previously to prepare an aqueous solution and then mixed in an electrolytic solution with a pump immediately before supplying a solution in an electrodeposited tank.

An added amount of the cellulose ether to the electrolytic solution is preferably 0.1 to 30 ppm, more preferably 1 to 10 ppm based on the electrolytic solution flowing amount supplyed to the electrodeposited tank. Generally, accompanying with the added amount of the cellulose ether, matte height can be suppressed low and roughness becomes small providing substantially no effect to an elongation value. However, if it is less than 0.1 ppm, its effect is too small, while it is added in excess of 30 ppm, roughness cannot be improved any more and economically undesired.

The cellulose ether may be combinedly used with other additives. For example, it may be added with glue, and high elongation can be obtained as compared with glue alone while elongation is slightly lowered due to addition of glue. Accordingly, the effect of adding cellulose ether itself is clear in this case.

When the cellulose ether is added to an electrolytic solution as described above, a copper foil electrodeposited at a cathode has fine nodules as compared with that to which cellulose ether is not added. Also, excessive growth of nodules to the direction of thickness of the foil which is a characteristic of a usual electrodeposited copper foil can be prevented and concentration of current can be inhibited whereby uniform growth can be promoted to X-Y direction. Thus, as compared with the conventional electrodeposited copper foil, recrystallization at lower temperature can easily be performed, and elongation at room temperature and high temperature and folding endurance can be improved. While detailed mechanism is unclear, according to addition of the cellulose ether, decrease in electrolytic polarization voltage is great by lowering in oxygen overvoltage at an anode and lowering in copper ion concentration overvoltage at a cathode interface. And thus, copper electrodeposition reaction can be performed rapidly and uniformly, whereby growth of crystals and crystal boundary to the direction of thickness can be suppressed.

EXAMPLES

In the following, examples of the present invention will be explained.

Example 1

| | |
|---|---|
| Copper | 100 g/l |
| Sulfuric acid | 100 g/l |
| Solution temperature | 60° C. |
| Supplying amount to electrodeposited tank: | Flow rate 50 cm/sec |

To the above copper sulfate aqueous solution which had been passed through an activated carbon filter were added each 1% aqueous solution of glue, sodium carboxymethyl cellulose or hydroxyethyl cellulose with amounts as shown below based on the flow amount of the copper sulfate aqueous solution supplyed to an electrodeposited tank.

| | | |
|---|---|---|
| Experimental No. 1 | Not added | |
| Experimental No. 2 | Glue | 1 ppm |
| Experimental No. 3 | Glue | 5 ppm |
| Experimental No. 4 | Sodium carboxymethyl cellulose | 1 ppm |
| Experimental No. 5 | Sodium carboxymethyl cellulose | 10 ppm |
| Experimental No. 6 | Hydroxyethyl cellulose | 5 ppm |
| Experimental No. 7 | Glue | 2 ppm |
| | Sodium carboxymethyl cellulose | 2 ppm |

By using the thus prepared electrolytic solution, and lead for an anode and a rotary drum made of titanium for a cathode, electrolysis was carried out with a current density of 50 A/dm$^2$ to prepare a copper foil having a thickness of 35 $\mu$m and compared with each other. Five points average of the matte side roughness $R_{max}$, tensile strength with elongation-trans at room temperature and maintained at 180° C. for 5 minutes, elongation and folding endurance by using MIT fold tester of the resulting copper foil were measured with n=2, respectively. Also, inspection of presence or absence of pinhole.microporosity was effected by the dye penetration method. The results are shown in Table 1.

TABLE 1

| Experimental No. | | Matte side roughnes $R_{max}(\mu)$ | at room temperature Tensile strength (kg/mm$^2$) | at room temperature Elongation trans. (%) | Maintained at 180° C. for 5 minutes Tensile strength (kg/mm$^2$) | Maintained at 180° C. for 5 minutes Elongation trans. (%) | MIT folding endurance (cycles) | Pinhole microporosity (number/m$^2$) |
|---|---|---|---|---|---|---|---|---|
| Comparative | 1 | 12.4 | 25.4 | 26.0 | 17.5 | 30.1 | 210 | 5 |
| | | 11.7 | 25.3 | 26.5 | 18.0 | 28.7 | 195 | |
| Conventional | 2 | 11.0 | 30.5 | 13.2 | 19.5 | 2.0 | 45 | None |
| | | 10.3 | 30.0 | 13.5 | 18.8 | 2.3 | 48 | |
| example | 3 | 8.1 | 31.1 | 4.5 | 20.5 | 1.3 | 21 | None |
| | | 7.5 | 30.8 | 5.2 | 20.0 | 1.0 | 18 | |

TABLE 1-continued

| Experimental No. | | Matte side roughnes $R_{max}(\mu)$ | at room temperature Tensile strength (kg/mm²) | at room temperature Elongation trans. (%) | Maintained at 180° C. for 5 minutes Tensile strength (kg/mm²) | Maintained at 180° C. for 5 minutes Elongation trans. (%) | MIT folding endurance (cycles) | Pinhole micro-porosity (number/m²) |
|---|---|---|---|---|---|---|---|---|
| Example of this invention | 4 | 5.5 | 30.2 | 25.5 | 16.5 | 17.3 | 155 | None |
| | | 6.2 | 29.5 | 26.0 | 16.0 | 18.7 | 161 | |
| | 5 | 3.5 | 31.0 | 24.3 | 17.8 | 14.5 | 132 | None |
| | | 3.9 | 30.5 | 25.0 | 17.3 | 15.0 | 135 | |
| | 6 | 3.4 | 29.8 | 25.3 | 16.9 | 13.7 | 140 | None |
| | | 3.6 | 30.0 | 23.8 | 17.1 | 13.0 | 128 | |
| | 7 | 4.0 | 30.3 | 19.5 | 18.5 | 6.5 | 102 | None |
| | | 4.5 | 31.3 | 18.4 | 18.8 | 5.7 | 95 | |

Example 2

In the same manner as in Sample No. 1, 3 and 6 of Example 1 except for electrolyzing the current density of 100 A/dm², copper foils were prepared having a thickness of 18 μm, 35 μm and 70 μm, respectively. Regarding these copper foils, the matte side roughness $R_{max}$ was measured. The results are shown in FIG. 1.

As described above, according to the present invention, profile of the matte side of the electrodeposited copper foil can be easily controlled, and the electrodeposited copper foil which is high above IPC specification Class 3 in elongation at room temperature and high temperature can be obtained. Thus, it can be applied to a copper foil for an internal and external layer of a high density wiring multilayer board and also to a copper foil for a flexible base material since folding endurance has been improved. Further, the method of the present invention is to simply add an additive to an electrolytic solution which has conventionally been used so that it is easy and the already installed facilities can be utilized whereby industrial and economical effects are also remarkable.

We claim:

1. A method of making electrodeposited copper foil which comprises electrodepositing copper from an electrolytic solution which contains a water-soluble cellulose ether.

2. A method according to claim 1, wherein said water-soluble cellulose ether is a compound in which a part or all of three hydroxyl groups of a unit cellulose represented by the following formula:

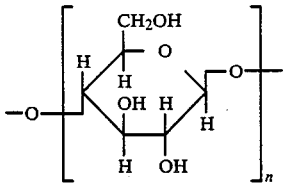

is/are etherified with a substituent(s).

3. A method according to claim 2, wherein said water-soluble cellulose ether is selected from the group consisting of sodium carboxymethyl cellulose, potassium carboxymethyl cellulose, ammonium carboxymethyl cellulose, hydroxyethyl cellulose, sodium carboxymethylhydroxyethyl cellulose, potassium carboxymethylhydroxyethyl cellulose, ammonium carboxymethylhydroxyethyl cellulose, methyl cellulose and cyanoethyl cellulose.

4. A method according to claim 2, wherein said water-soluble cellulose ether is in an amount of 0.1 to 30 ppm based on the electrolytic solution.

5. A method according to claim 4, wherein said water-soluble cellulose ether is in an amount of 1 to 10 ppm based on the electrolytic solution.

6. A method according to claim 1, wherein said electrolytic solution consists essentially of an acid aqueous copper sulfate solution.

7. A method according to claim 3, wherein said electrolytic solution consists essentially of an acid aqueous copper sulfate solution.

8. A method according to claim 7, wherein said water-soluble cellulose ether is in an amount of 1 to 10 ppm based on the electrolytic solution.

9. A method according to claim 8, wherein said water-soluble cellulose ether is sodium carboxymethyl cellulose.

10. A method according to claim 8, wherein said water-soluble cellulose ether is sodium hydroxyethyl cellulose.

11. A method according to claim 7, wherein said water-soluble cellulose ether is in an amount of 0.1 to 30 ppm based on the electrolytic solution.

* * * * *

UNITED STATES PATENT AND TRADEMARK OFFICE

CERTIFICATE OF CORRECTION

PATENT NO. : 4,976,826

DATED : December 11, 1990

INVENTOR(S) : TANI et al

It is certified that error appears in the above-identified patent and that said Letters Patent is hereby corrected as shown below:

Title Page, [75] Inventors: Replace "Noborn Matsuki" with --Noboru Matsuki--.

Column 6, line 54 (Claim 10): Delete "sodium".

Signed and Sealed this

Twenty-fifth Day of August, 1992

*Attest:*

DOUGLAS B. COMER

*Attesting Officer*

*Acting Commissioner of Patents and Trademarks*